US007000786B2

(12) United States Patent
Heiner

(10) Patent No.: US 7,000,786 B2
(45) Date of Patent: Feb. 21, 2006

(54) ROTATING DISPLAY SYSTEM

(76) Inventor: Twila G. Heiner, 26325 N. Warren Rd., Athol, ID (US) 83801

( * ) Notice: Subject to any disclaimer, the term of this patent is extended or adjusted under 35 U.S.C. 154(b) by 81 days.

(21) Appl. No.: 10/338,195

(22) Filed: Jan. 7, 2003

(65) Prior Publication Data

US 2003/0127405 A1 Jul. 10, 2003

Related U.S. Application Data

(60) Provisional application No. 60/346,730, filed on Jan. 8, 2002.

(51) Int. Cl.
*A47F 5/00* (2006.01)

(52) U.S. Cl. ..... 211/163; 211/58

(58) Field of Classification Search ..... 211/163, 211/45, 58; 40/493, 501, 506; 312/234, 312/125

See application file for complete search history.

(56) References Cited

U.S. PATENT DOCUMENTS 770,908 A * 9/1904 Holt ..... 254/258
2,886,184 A * 5/1959 Crone ..... 211/58
4,681,232 A * 7/1987 Du Corday ..... 211/46
5,057,977 A * 10/1991 Kurzman ..... 362/125
5,433,036 A * 7/1995 Ganal ..... 40/729
5,462,178 A * 10/1995 Wallach et al. ..... 211/163
5,586,664 A * 12/1996 Taylor ..... 211/58
6,102,502 A * 8/2000 Melillo et al. ..... 211/41.16
6,575,314 B1 * 6/2003 Lung et al. ..... 211/163

* cited by examiner

*Primary Examiner*—Alvin C. Chin-Shue

(57) ABSTRACT

A rotating display system for assisting customers in visualizing various combinations of structures used in kitchens and bathroom, such as cabinets, countertops, backsplashes, flooring, and shower walls. The rotating display system includes a cabinet display rotatably supported above a surface, a countertop display rotatably positioned above the cabinet display, and a backwash display rotatably positioned above said countertop display. The cabinet display has a plurality of sample cabinet surfaces, the countertop display has a plurality of sample countertop surfaces, and the backsplash display has a plurality of sample backsplash surfaces. The user rotates the cabinet display, the countertop display and the backsplash display to visually illustrate various options and combinations.

4 Claims, 8 Drawing Sheets

ROTATING DISPLAY SYSTEM

CROSS REFERENCE TO RELATED APPLICATIONS

I hereby claim benefit under Title 35, United States Code, Section 119(e) of U.S. provisional patent application Ser. No. 60/346,730 filed Jan. 8, 2002. The 60/346,730 application is currently pending. The 60/346,730 application is hereby incorporated by reference into this application.

BACKGROUND OF THE INVENTION

1. Field of the Invention

The present invention relates generally to building-material displays and more specifically to a rotating display system for assisting customers in visualizing various combinations of structures used in kitchens and bathrooms such as cabinets, countertops, backsplashes, flooring, and shower walls.

2. Description of the Related Art

Displays in the building industry have been in use for years. The most commonly utilized display is comprised of a rack displaying a plurality of countertop surface material that is not usually displayed with the other coordinating surfaces together. Another type of display is a board structure that supports a plurality of tile or countertop materials to illustrate the available options. The user must bring the product samples together with other surface options into a single location for visualization. Usually not all samples are available in one store.

The main problem with conventional displays is that they do not allow the user to combine and visually see various combinations of the coordinating surfaces together. A further problem with conventional displays is that numerous display units are required which consumes a significant amount of showroom space. Another problem with conventional displays is that it is time consuming for users to bring product samples to other stores for comparison purposes. Another problem with conventional displays is that they do not provide an accurate representation of the overall appearance of the combination in a building setting.

While these devices may be suitable for the particular purpose to which they address, they are not as suitable for assisting customers in visualizing various combinations of structures used in kitchens and bathrooms such as cabinets, countertops, backsplashes, flooring, and shower walls. Conventional building material displays do not provide an efficient display system that can be easily utilized for effectively displaying various combinations of coordinating building materials.

In these respects, the rotating display system according to the present invention substantially departs from the conventional concepts and designs of the prior art, and in so doing provides an apparatus primarily developed for the purpose of assisting customers in visualizing various combinations of structures used in kitchens and bathrooms such as cabinets, countertops, backsplashes, flooring, and shower walls.

BRIEF SUMMARY OF THE INVENTION

In view of the foregoing disadvantages inherent in the known types of displays now present in the prior art, the present invention provides a new rotating display system construction wherein the same can be utilized for helping customers visualize various coordinating surfaces including but not limited to cabinet, countertop and backsplash options thereby facilitating purchases.

The general purpose of the present invention, which will be described subsequently in greater detail, is to provide a new rotating display system that has many of the advantages of the displays mentioned heretofore and many novel features that result in a new rotating display system which is not anticipated, rendered obvious, suggested, or even implied by any of the prior art displays, either alone or in any combination thereof.

To attain this, the present invention generally comprises a frame with each part being rotatable and able to be used to display (but not limited to) a cabinet display rotatably supported above a surface, a countertop display rotatably positioned above the cabinet display, and a backwash display rotatably positioned above said countertop display. The cabinet display has a plurality of sample cabinet surfaces, the countertop display has a plurality of sample countertop surfaces, and the backsplash display has a plurality of sample backsplash surfaces. The user rotates the cabinet display, the countertop display and the backsplash display to visually illustrate various options and combinations, or, in the example of a shower display, can be constructed to fit shower wall sample panels with two or more layers and a flooring layer.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a rotating display system that will overcome the shortcomings of the prior art devices.

A second object is to provide a rotating display system for assisting customers in visualizing various combinations of structures used in kitchens and bathrooms such as cabinets, countertops, backsplashes, flooring, and shower walls.

Another object is to provide a rotating display system that is compact in size and requires a minimal amount of showroom space.

An additional object is to provide a rotating display system that provides one convenient location for customers to view various options and combinations of coordinating surfaces.

A further object is to provide a rotating display system that is easily manipulated to achieve various combinations.

Another object is to provide a rotating display system that provides an actual visual and physical representation of various combinations of coordinating surfaces.

A further object is to provide a rotating display system that assists salespeople in designing a space and which reduces the amount of time spent with each customer.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated or surfaces used for display and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
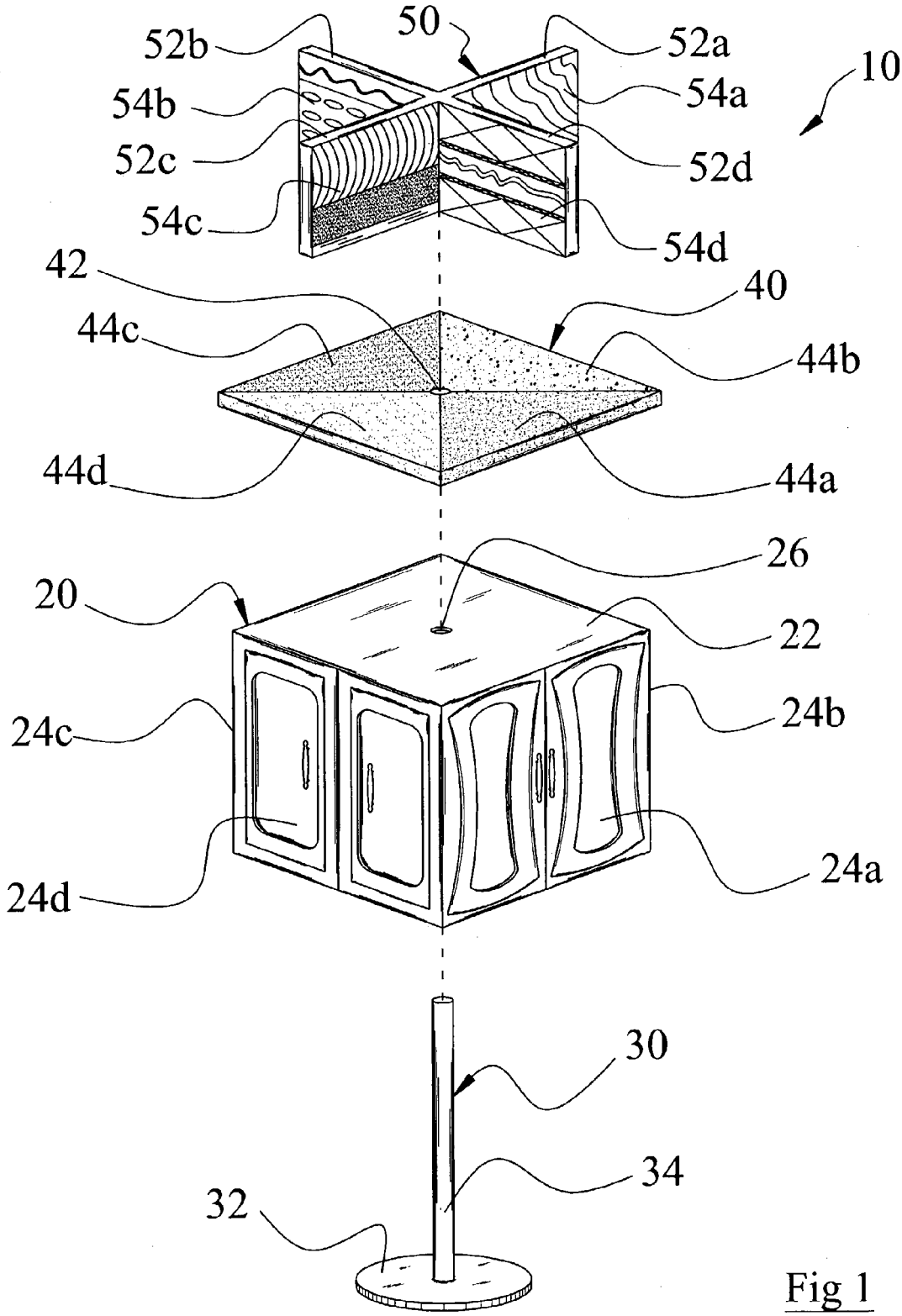
FIG. 1 is an exploded upper perspective view of a first embodiment of the present invention.

Turning now descriptively to the drawings, in which similar reference characters denote similar elements throughout the several views. FIGS. 1 through 5 illustrate a rotating display system 10, which comprises a cabinet structure 20 to display (for example) a sample cabinet display, a frame to display, for example, a countertop display 40 rotatably positioned above the cabinet display rack 20, and frame or structure to display, for example, a backsplash display rotatably positioned above said countertop display 40. The cabinet display 20 has a plurality of sample cabinet surfaces, the countertop display 40 has a plurality of sample countertop surfaces, and the backsplash display 50 has a plurality of sample backsplash surfaces. The user rotates the cabinet display 20, the countertop display 40 and the backsplash display 50 to visually illustrate various options and combinations. It can be appreciate that other coordinating surface materials can be used for display on this rotating display system.

B. Support Stand

FIG. 1 illustrates an exemplary support stand 30 for rotatably supporting the cabinet display 20, the countertop display 40 and the backsplash display 50. It can be appreciated that various other support structures may be utilized to rotatably support the cabinet display 20, the countertop display 40 and the backsplash display 50 with respect to one another and the support stand 30 illustrated is merely for illustration purposes. For example, the cabinet display 20, the countertop display 40 and the backsplash display 50 could be directly rotatably supported upon one another utilizing bearings, wheels or similar rotating mechanisms.

The support stand 30 has a support base 32 and a support pole 34 extending from the support base 32. The support base 32 may have various broad structures for adequately supporting the cabinet display 20, the countertop display 40 and the backsplash display 50. For example, the support base 32 may have a broad structure, as shown in FIG. 1, or the support base 32 may have a plurality of horizontal leg units. The support pole 34 is preferably comprised of an elongate rigid structure.

The support pole 34 extends upwardly from the support base 32 and rotatably receives the cabinet display 20, the countertop display 40 and the backsplash display 50. The cabinet display 20, the countertop display 40 and the backsplash display 50 are preferably removably attached to the support pole 34 utilizing conventional fastening devices which allow for rotatably supporting the respective cabinet display 20, the countertop display 40 and the backsplash display 50 with respect to one another. For example, locking collars may be attached to the support stand 30 with bearings attached to the cabinet display 20, the countertop display 40 and the backsplash display 50 which rotatably rest upon the locking collars. Various other rotating structures may be utilized to rotatably support the cabinet display 20, the countertop display 40 and the backsplash display 50 with respect to one another.

C. Cabinet Display

The cabinet display 20 is the base of the present invention which is rotatably supported upon or above a floor surface. For example, the cabinet display 20 may have an upper surface 22 with a cabinet aperture 26 within for receiving the support pole 34 as shown in FIG. 1 of the drawings.

Figure 2:
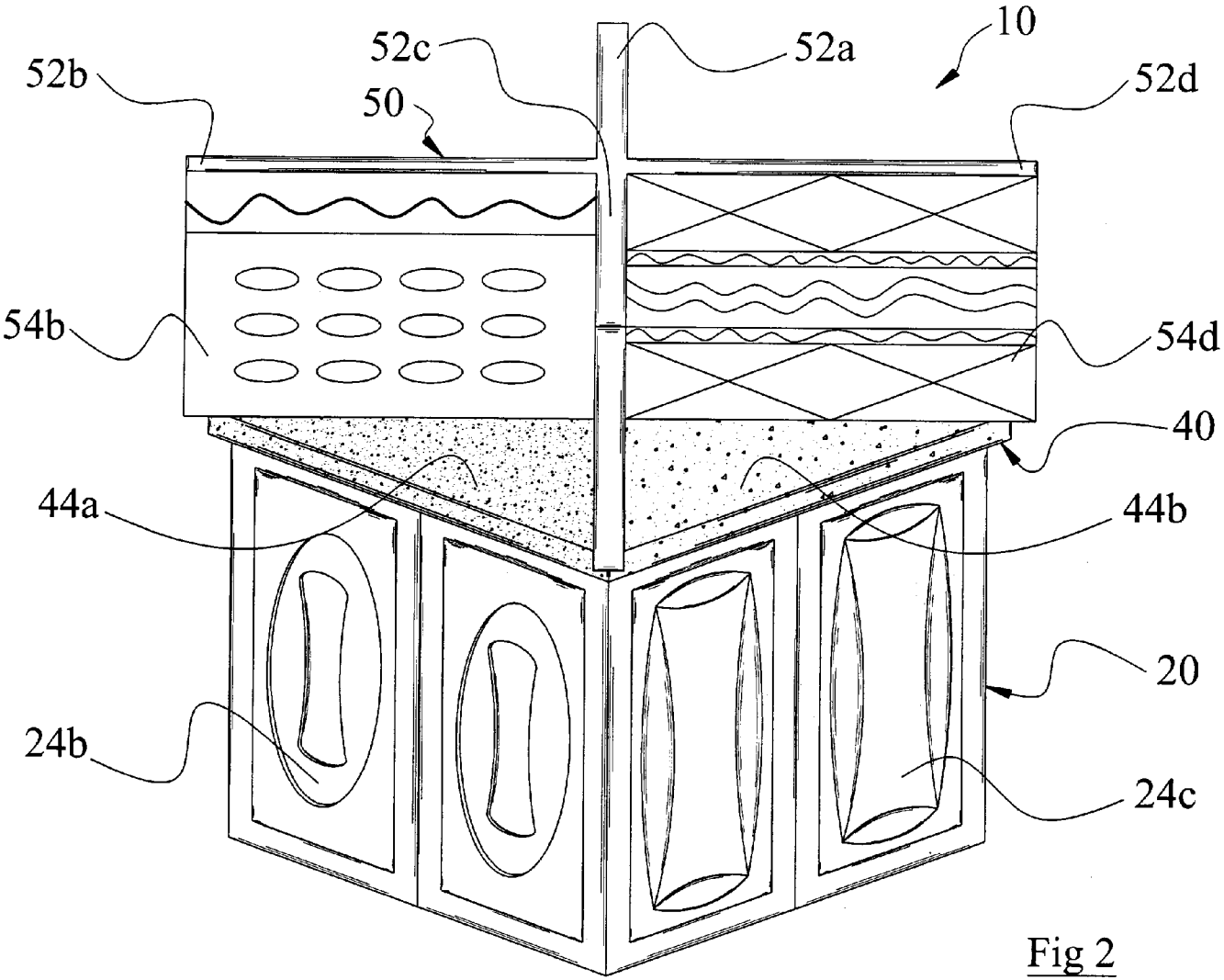
FIG. 2 is an upper perspective view of the present invention.
Figure 3:
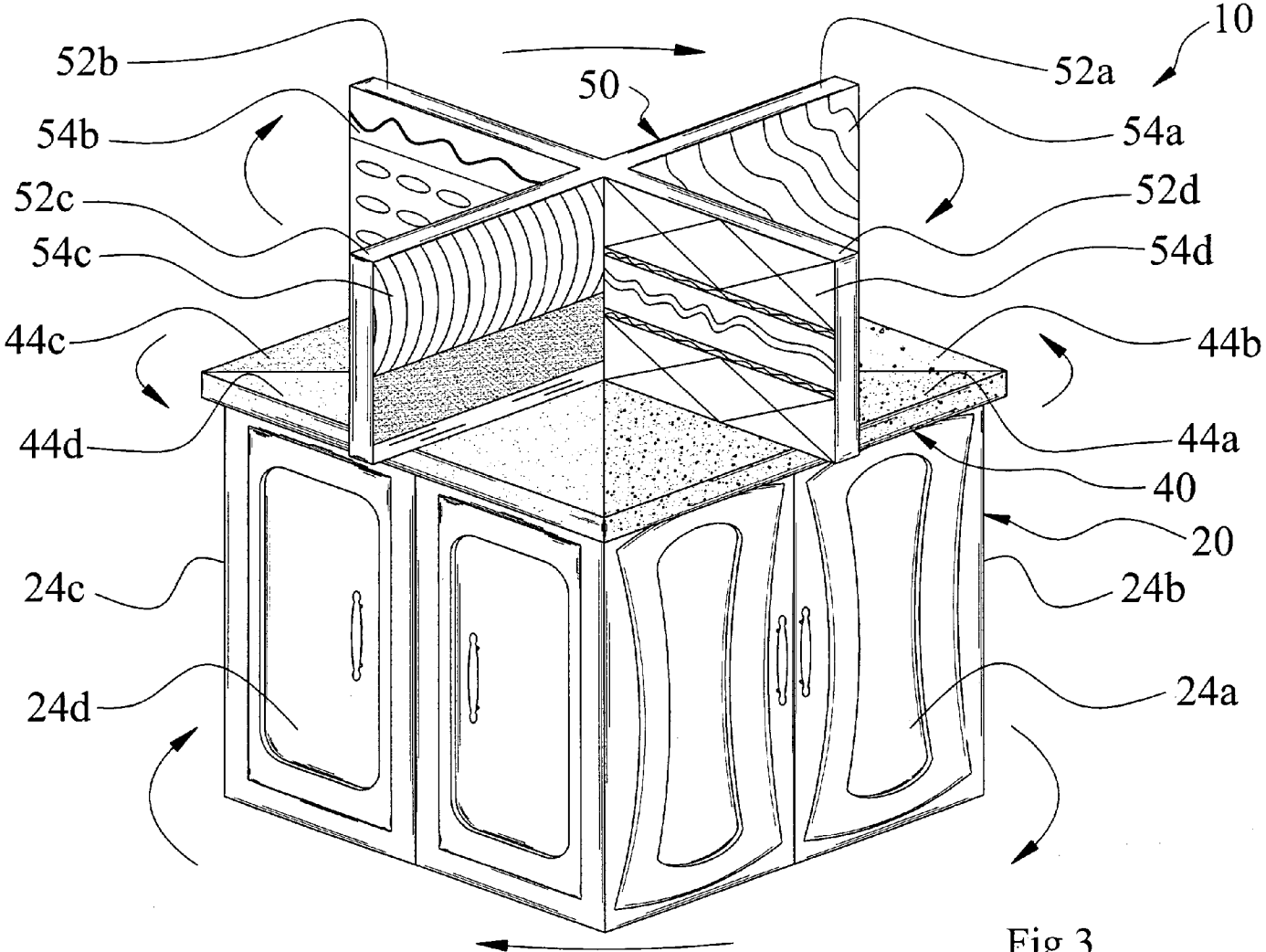
FIG. 3 is an upper perspective of the present invention illustrating some rotational movements of the main components.
Figure 8:
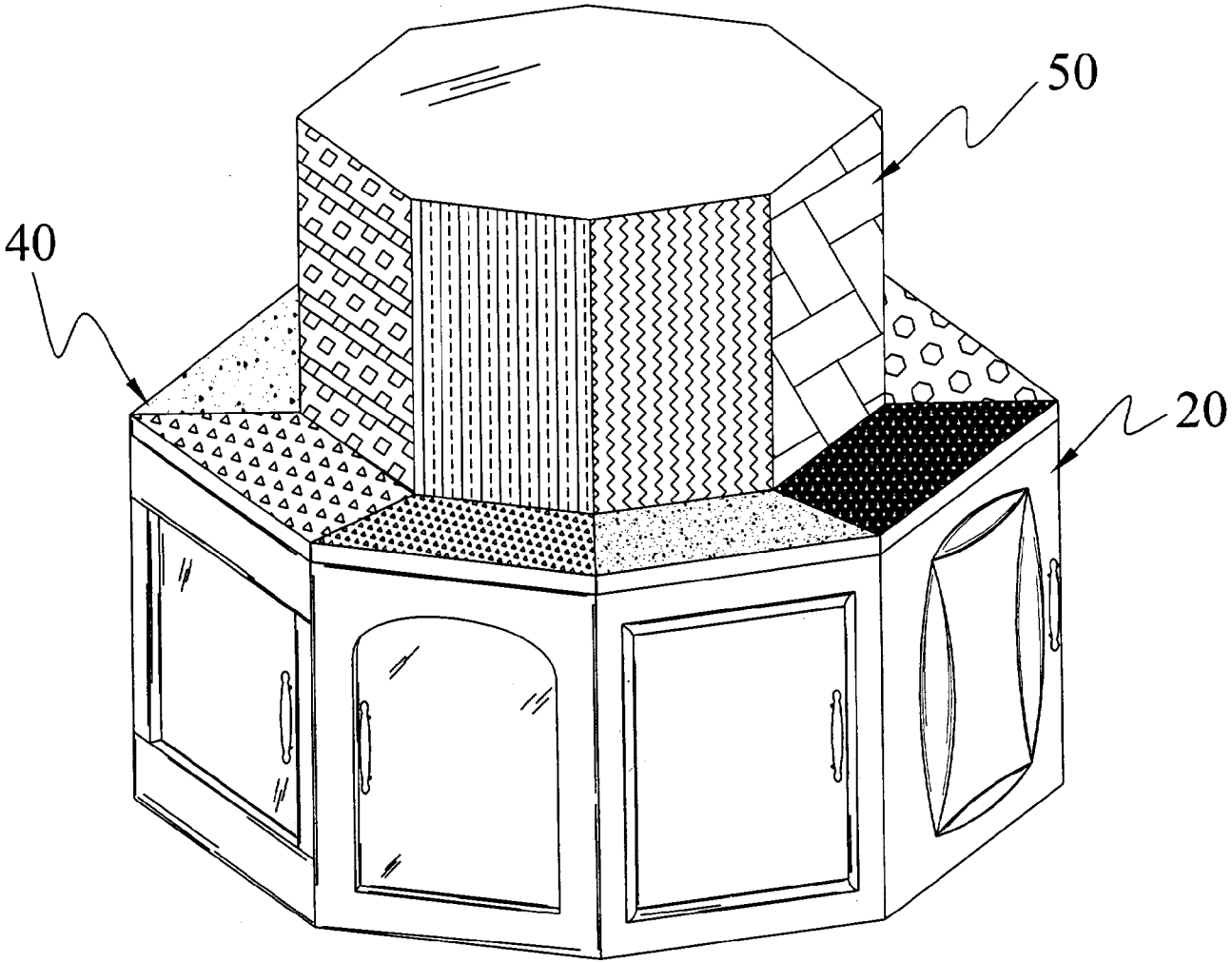
FIG. 8 is an upper perspective view of a fourth embodiment of the present invention.

The cabinet display 20 has a plurality of cabinet sections 24*a–d* preferably forming a square, rectangular, oval or polygonal structure. The number of cabinet sections 24*a–d* may vary such as but not limited to 2, 3, 4, 5, 6, 7 and 8 or more sections. FIG. 8 illustrates an alternative embodiment where the sections face outwardly instead of towards one another. The applicant has found that 4 cabinet sections 24*a–d* provides minimum the desired visual effect as shown in FIG. 2 of the drawings. The cabinet sections 24*a–d* preferably have a height and width similar to a conventional lower cabinet and may be constructed in a horizontal or parallel manner depending on the surface material being displayed.

Each of the cabinet sections 24*a–d* for example purposes represents a various cabinet options for the user. The cabinet sections 24*a–d* may have various wood and material types, styles, structures, colors and textures. The drawings merely illustrate some exemplary cabinet designs for illustration purpose and should not limit the present invention.

D. Countertop Display

The countertop display 40 for example purposes is a relative flat structure for this example representing a countertop surface. The countertop display 40 is rotatably supported upon or above the upper surface 22 of the cabinet display 20. The countertop display 40 has a countertop aperture 42 that rotatably receives the support pole 34 as shown in FIG. 1 of the drawings.

The countertop display 40 has a plurality of cabinet sections 44*a–d* preferably forming a triangular, square, rectangular, oval or polygonal shape. FIG. 8 illustrates an alternative embodiment where the sections face outwardly instead of towards one another. The number of countertop sections 44*a–d* may vary such as but not limited to 2, 3, 4, 5, 6, 7 and 8 sections. It is desirable to utilize the same number of countertop sections 44*a–d* as the number of cabinet sections 24*a–d* utilized, though various other countertop sections 44*a–d* may be utilized. The countertop sections 44*a–d* preferably extend from each corner of the cabinet sections 24*a–d* toward a central location.

The countertop display 40 has a plurality of countertop sections 44*a–d* that represent various countertop options for the user. The countertop sections 44*a–d* may have various material types, styles, colors, thicknesses, and textures. The drawings merely illustrate some exemplary countertop designs for illustration purposes and should not limit the present invention.

E. Backsplash Display

Figure 4:
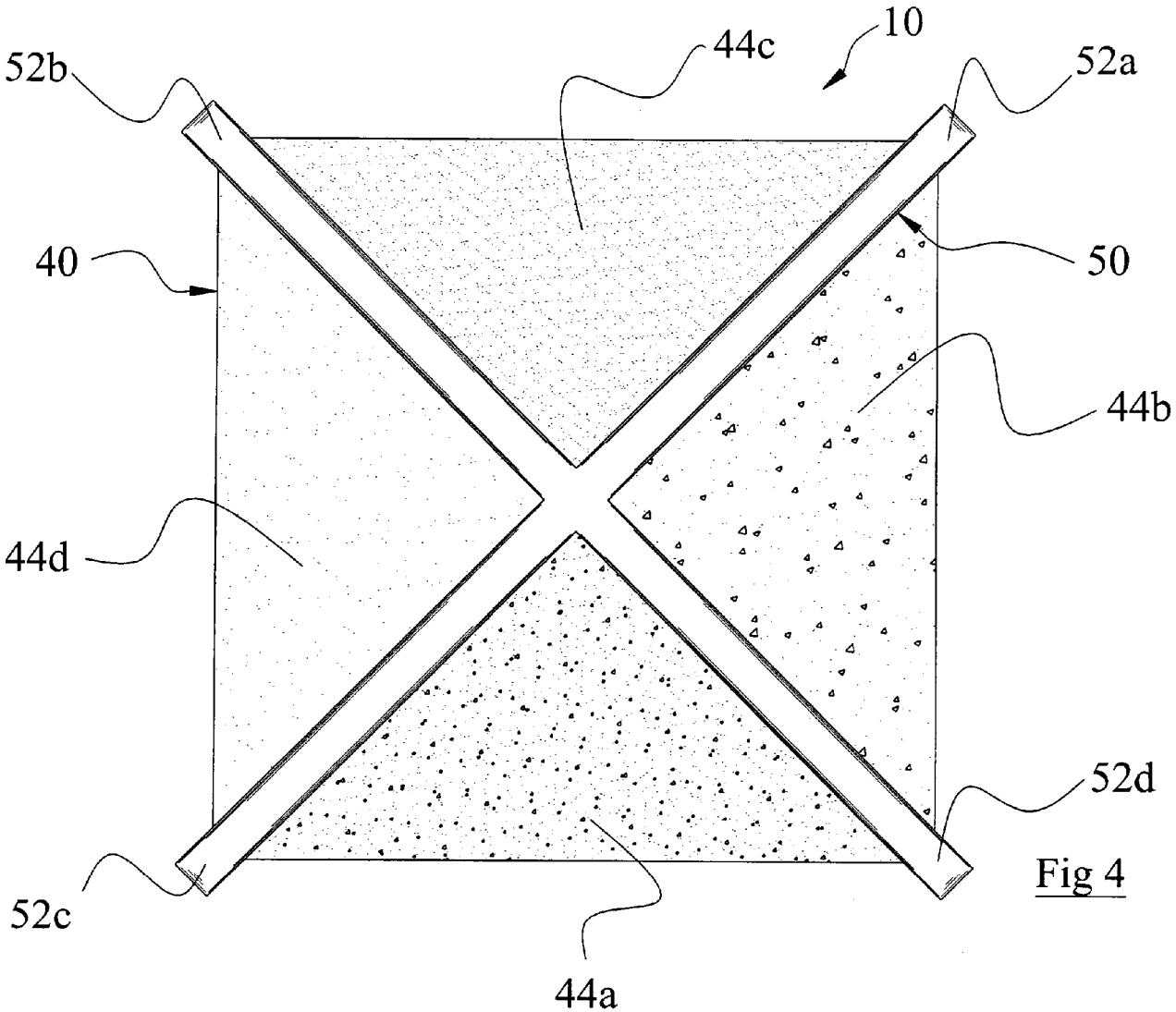
FIG. 4 is a top view of the present invention.

The backsplash display 50, for purposes of example only, is comprised of a plurality of partitions 52*a–d* for illustrating various backsplash designs. FIG. 8 illustrates an alternative embodiment where the sections face outwardly instead of towards one another. The number of partitions 52*a–d* utilized depends upon the number of countertop sections 44*a–d* utilized. The partitions 52*a–d* are formed to align along the borders of each of the countertop sections 44*a–d* as best illustrated in FIG. 4 of the drawings. In the preferred embodiment of the present invention, four partitions 52*a–d* are utilized forming an X-shaped structure as best illustrated in FIGS. 2 and 4 of the drawings.

The backsplash display 50 is preferably rotatably positioned upon or above the countertop display 40. For example, the backsplash display 50 may be rotatably attached to the upper portion of the support pole 34.

The backsplash display 50 has a plurality of backsplash sections 54*a–d* which represent various backsplash options for the user. The backsplash sections 54*a–d* may have various material types, styles, colors, designs, and textures. The drawings merely illustrate some exemplary backsplash designs for illustration purposes and should not limit the present invention, nor should this display be limited to backsplashes.

F. Alternative Embodiment

Figure 6:
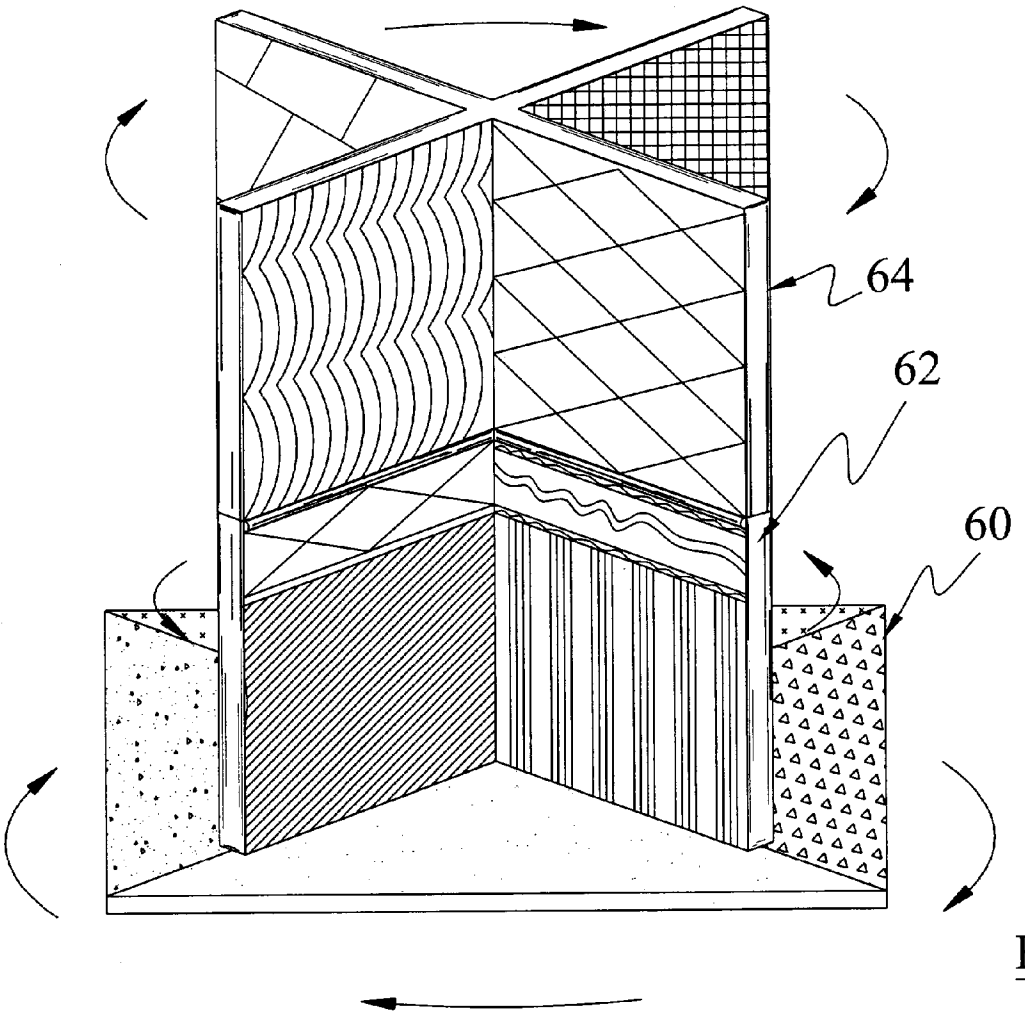
FIG. 6 is an upper perspective view of a second embodiment of the present invention.

FIG. 6 illustrates a second embodiment of the present invention. The second embodiment has a flooring display 60 which has a plurality sections that may have various material types, styles, colors, designs, and textures. The drawings merely illustrate some exemplary flooring designs for illustration purposes and should not limit the present invention, nor should this display be limited to flooring materials. The flooring display 60 may be added separately by the user or it may be integral with the present invention.

The second embodiment also has a lower wall display 62 which has a plurality sections that may have various material types, styles, colors, designs, and textures. The lower wall display 62 is rotatably positioned upon or above the flooring display 60 as shown in FIG. 6 of the drawings. The drawings merely illustrate some exemplary lower wall designs for illustration purposes and should not limit the present invention, nor should this display be limited to wall materials.

The second embodiment also has an upper wall display 64 which has a plurality sections that may have various material types, styles, colors, designs, and textures. The upper wall display 64 is rotatably positioned upon the lower wall display 62 as shown in FIG. 6 of the drawings. The drawings merely illustrate some exemplary lower wall designs for illustration purposes and should not limit the present invention, nor should this display be limited to wall materials.

Figure 7:
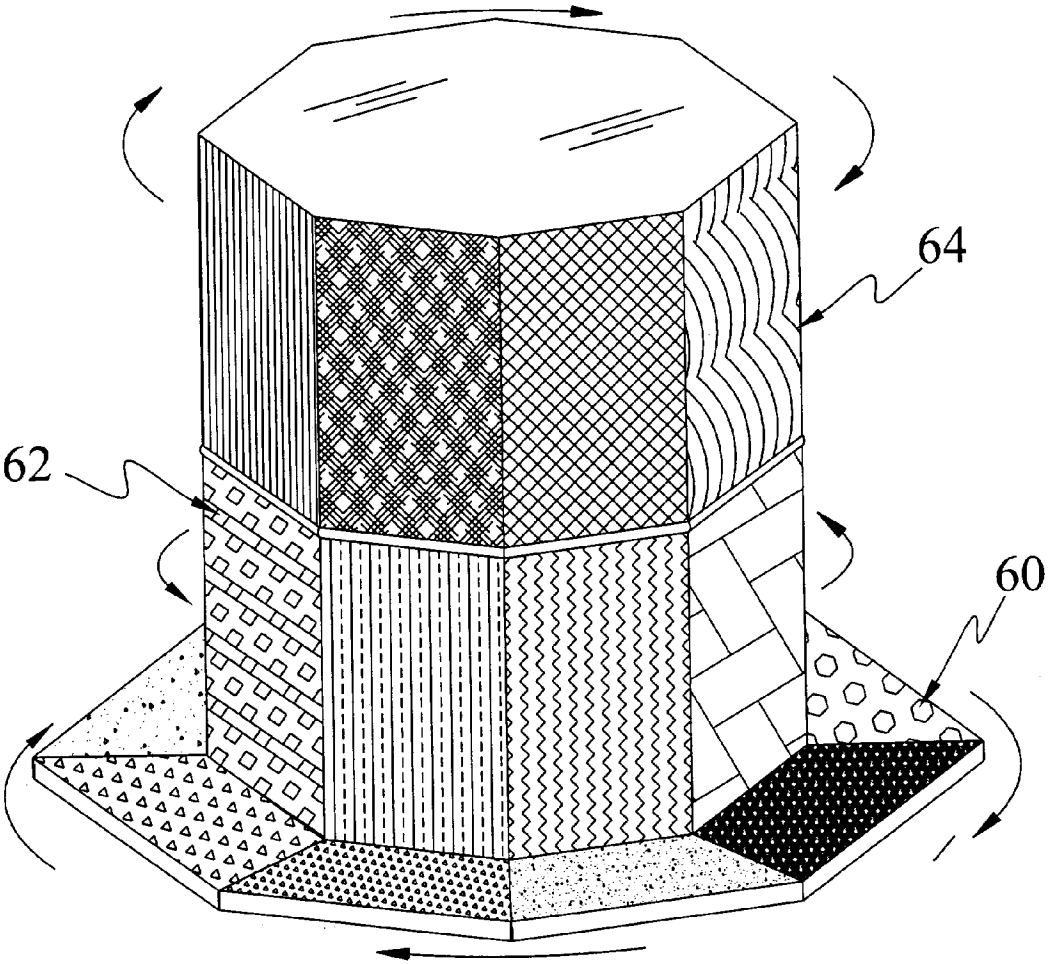
FIG. 7 is an upper perspective view of a third embodiment of the present invention.

FIG. 7 of the drawings illustrates a third embodiment which simply utilizes the exterior surfaces of polygonal structures to create the desired combinations. The present invention should not be limited to the structures as shown in the drawings.

G. Operation

Figure 5:
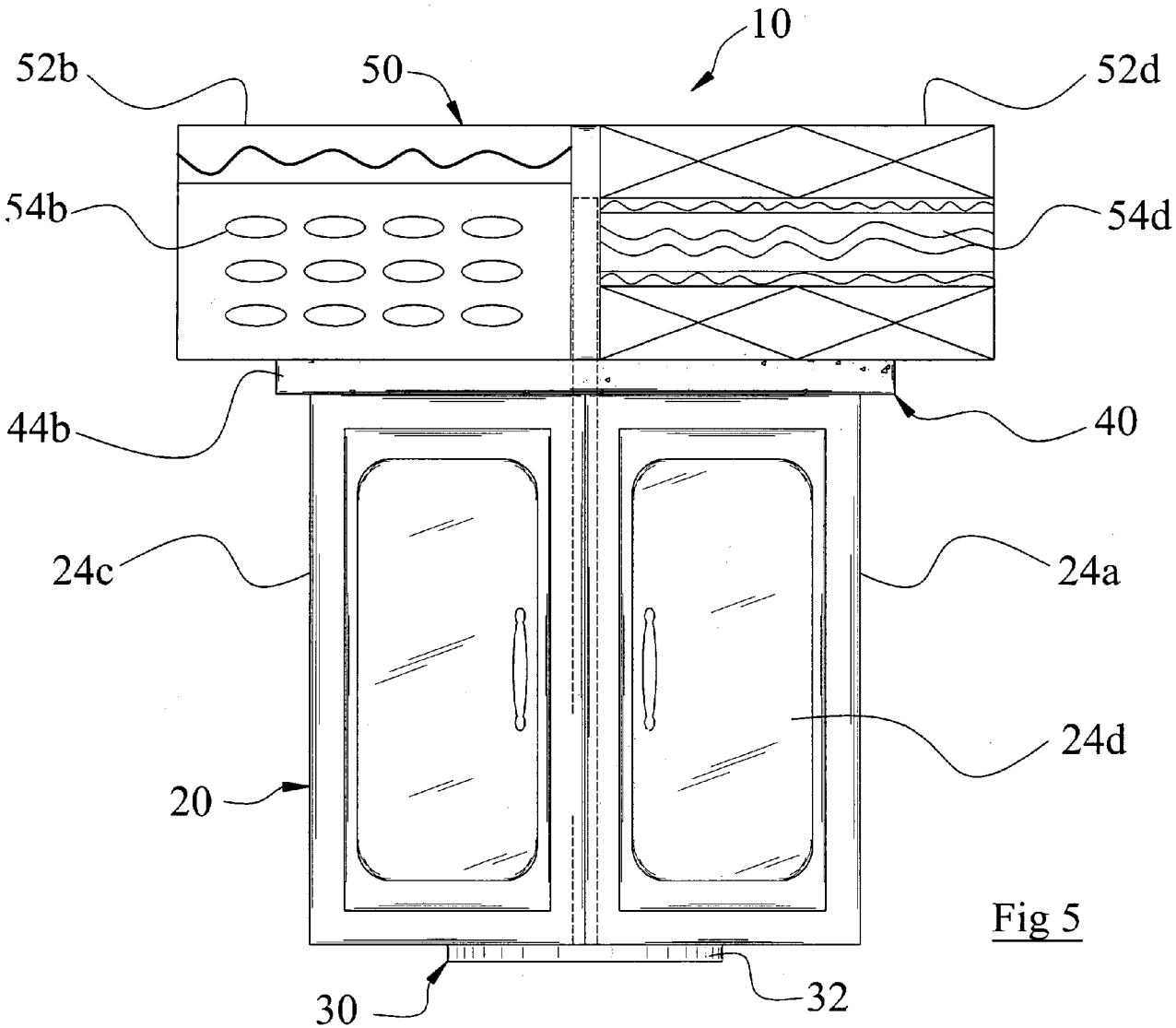
FIG. 5 is a front view of the present invention.

In use, the user rotates the cabinet display 20, the countertop display 40 and the backsplash display 50 until a desired combination is achieved. For example, the user may first select a desired cabinet appearance by selecting one of the cabinet sections 24*a–d*. The selected cabinet section is retained towards the front as shown in FIG. 5 and the user then rotates the countertop display 40 until a desired countertop-cabinet combination is achieved. The user then rotates the backsplash display 50 until the desired countertop-cabinet-backsplash combination is achieved as shown in FIGS. 2 and 4 of the drawings. When the desired combination is shown, the partitions 52*a–d* hide the non-selected countertop sections 44*a–d* thereby providing the user with an overall visualization of the selected countertop-cabinet-backsplash combination.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotating display system for displaying various building material combinations, comprising;

a support stand;

a first display rotatably attached to said support stand, said first display constructed as a plurality of cabinet sections each having a different cabinet design; and a second display constructed as a horizontally oriented countertop with a plurality of countertop sections each having a different design rotatably attached to said support stand concentrically above said first display and rotatable relative to the first display, wherein said counter top sections vertically align in a plurality of combination with said cabinet sections; and a third display comprising a plurality of vertically oriented walls intersecting at their mid-points and presenting a plurality of vertically oriented display surface, said plurality of vertically display surface comprising a plurality of different backsplash design, said third display rotatably attached to said support stand at the intersecting mid-points concentrically above said second display and rotatable relative to said second display, wherein said backsplash sections vertically align in a plurality of combination with said countertop sections and said cabinet sections, wherein different design of cabinets and countertops and backsplashes may be displayed.

2. The rotating display system of claim 1, wherein said plurality of cabinet sections are comprised of four sections.

3. The rotating display system of claim 1, wherein said plurality of countertop sections are comprised of four sections.

4. The rotating display system of claim 1, wherein said plurality of backsplash sections are comprised of four sections.

* * * * *